US011433636B2

(12) United States Patent
Peleman et al.

(10) Patent No.: US 11,433,636 B2
(45) Date of Patent: Sep. 6, 2022

(54) DEVICE FOR FOLDING SHEETS

(71) Applicant: PELEMAN INDUSTRIES, NAAMLOZE VENNOOTSCHAP, Puurs (BE)

(72) Inventors: Guido Frans M Peleman, Knokke-Heist (BE); Maarten Luc C. Hennissen, Puurs (BE)

(73) Assignee: PELEMAN INDUSTRIES, NAAMLOZE VENNOOTSCHAP, Puurs (BE)

( * ) Notice: Subject to any disclaimer, the term of this patent is extended or adjusted under 35 U.S.C. 154(b) by 825 days.

(21) Appl. No.: 16/332,685

(22) PCT Filed: Sep. 15, 2017

(86) PCT No.: PCT/IB2017/055597

§ 371 (c)(1),
(2) Date: Mar. 12, 2019

(87) PCT Pub. No.: WO2018/069776

PCT Pub. Date: Apr. 19, 2018

(65) Prior Publication Data

US 2021/0291476 A1 Sep. 23, 2021

(30) Foreign Application Priority Data

Oct. 10, 2016 (BE) ..... 2016/5758

(51) Int. Cl.
*B42C 5/00* (2006.01)
*B31F 1/00* (2006.01)
(Continued)

(52) U.S. Cl.
CPC ..... *B31F 1/0019* (2013.01); *B42C 5/00* (2013.01); *B65H 45/00* (2013.01); *B65H 45/12* (2013.01); *B65H 45/22* (2013.01)

(58) Field of Classification Search
None
See application file for complete search history.

(56) References Cited

U.S. PATENT DOCUMENTS 3,961,783 A * 6/1976 Beaudoin ..... B65B 63/04 493/935
4,022,457 A * 5/1977 Marin ..... B65H 45/22 493/441

(Continued)

FOREIGN PATENT DOCUMENTS

WO 2014/072778 A1 5/2014

OTHER PUBLICATIONS

International Search Report, dated Nov. 10, 2017, from corresponding PCT/IB2017/055597 application.

*Primary Examiner* — Leslie A Nicholson, III
(74) *Attorney, Agent, or Firm* — Nixon & Vanderhye

(57) ABSTRACT

Disclosed is a device for folding sheets, the device provided with two transport belts positioned opposite each other in such a way that sheets can be clamped between the transport belts with the exception of a protruding part that protrudes between the transport belts, whereby the device is provided with two slats that extend along the transport belts and between which the protruding part can slide so a strip protrudes between the slats, whereby the device is also provided with one or more folding elements along the transport belts that can fold the abovementioned strip over or around a slat to form a fold line and whereby the device is such that it guides the sheets with their strip along the folding elements and the slats by the driver of the transport belts.

24 Claims, 5 Drawing Sheets

(51) Int. Cl.

| | |
|---|---|
| ***B65H 45/00*** | (2006.01) |
| ***B65H 45/12*** | (2006.01) |
| ***B65H 45/22*** | (2006.01) |

(56) References Cited

U.S. PATENT DOCUMENTS

| | | | | | |
|---|---|---|---|---|---|
| 4,557,715 | A | * | 12/1985 | Robinson | B31B 70/00 493/918 |
| 4,784,379 | A | * | 11/1988 | Vander Syde | B43M 3/02 53/284.3 |
| 5,037,365 | A | * | 8/1991 | Breton | B65H 43/00 493/441 |
| 5,714,027 | A | * | 2/1998 | Taub | A61F 13/15699 156/227 |
| 5,807,228 | A | * | 9/1998 | Smithe | B65H 45/22 493/438 |
| 5,868,727 | A | * | 2/1999 | Barr | A61F 13/5616 604/387 |
| 6,027,440 | A | * | 2/2000 | Roth | B65H 5/228 493/436 |
| 8,273,003 | B2 | * | 9/2012 | Umebayashi | B65H 23/032 493/422 |
| 2007/0203008 | A1 | | 8/2007 | Parker et al. | |

* cited by examiner

DEVICE FOR FOLDING SHEETS

The present invention concerns a device for folding sheets.

More particularly, the invention is intended to obtain sheets of which a strip is folded over along a line, said sheets being sheets for a book or folder with the sheets being able to be folded open flat.

Moreover, any printing can continue seamlessly over the two folded open sheets. The latter is particularly desired for the compilation of photo albums, magazines and suchlike with photos and illustrations continuing over the complete width of the opened book.

In practice one will fold the strip over double to achieve this purpose, i.e. being able to open it flat.

Here folding double means the strip is first folded over in one direction and then in the other direction.

The fold line thus obtained will allow the sheets to be folded opened along this fold line and, when the stack of sheets is bound in a spine, to lie with their sharp fold lines against each other and lie flat so the folded sheets lie nice and flat and can be easily read, and printing can also continue as good as seamlessly over the folded open sheets.

Instead of binding the stack in a spine, the stack can also be bound by means of PUR adhesive, applied in a clip folder or bound in another way.

Moreover, there is no slit between the folded open sheets when the stack is folded open, so the adhesive, stitching or staples used to bind the stack in the spine are not visible so also not a hindrance to printing that runs from one sheet to the other.

DESCRIPTION OF THE RELATED ART

Devices for the double folding of sheets are already known, as described in international patent application WO 2014/072778, whereby a sheet of paper is clamped between two plates with a protruding strip of for example approximately 15 millimetres.

This strip is folded downwards and upwards with a V-shaped element. Whereby the paper will be static in relation to the device, and consequently much time is lost with the introduction, positioning and sorting of the sheets of paper.

It has appeared difficult in practice to achieve the double folding of the sheets in less than three seconds, meaning approximately 1,200 sheets per hour.

Such limited totals require very many machines to achieve an acceptable production quantity.

SUMMARY OF THE INVENTION

The purpose of the present invention is to provide a solution to at least one of the abovementioned and other disadvantages.

The present invention concerns a device for folding sheets, whereby the device is provided with two transport belts positioned opposite each other in such a way that sheets can be clamped between the transport belts with the exception of a protruding part that protrudes between the transport belts, whereby the device is provided with two slats that extend along the transport belts and between which the protruding part can slide so a strip protrudes between the slats, whereby the device is also provided with one or more folding elements along the transport belts that can fold the abovementioned strip over or around a slat to form a fold line and whereby the device is such that it guides the sheets with their strip along the folding elements and the slats by the drive means of the transport belts.

Here 'against each other' means 'functionally against each other' or 'practically against each other'. This means the transport belts, puller belts or conveyor belts are located close to each other in such a way that a sheet positioned between the transport belts is clamped and taken along by the drive means of the transport belts. A requirement here is that there is sufficient friction or clamping force. Such a requirement is easy for a person skilled in the art to achieve by trial-and-error.

An advantage is that the transport belts can guide the sheets along the folding elements and pressing elements at high speed.

No further successive operations are then required such as the sheet after sheet introduction, positioning and sorting to fold the strip of the sheets. The sheets can consecutively pass along the folding elements and are folded over during their passage at the folding elements.

Such a dynamic way of working will considerably increase the production speed.

An additional advantage is that the friction with the sheet guided along the slats will cause an abrasive effect in the fold line formed, so a well-defined and strong fold is formed.

Preferably, but not required for the invention, the device is also provided with one or more pressing elements that are placed after a folding element and can press the folded over strip against the sheet and the fold line, whereby the abovementioned slats are at least partly discontinued at the location of the pressing elements.

The pressing elements will firmly press the fold formed so a sharp fold line is created. This has the consequence that in most cases it is not necessary to fold the strip double.

However, if this is still required, for example with thicker or stronger paper, it can be easily done. By placing an additional folding element along the transport belts that will fold the strip in the other direction and a possible second pressing element, one will obtain a device for folding sheets double.

The slats are preferably aligned with each other on the side of the strip.

This means that they run perfectly level so a fold upwards and a fold downwards are formed on exactly the same fold line.

This has the advantage that, if the device is provided with at least one folding element that folds the strip in one direction and at least one folding element that folds the strip in the other direction, both such folds are formed in exactly the same place or fold line.

The folding elements can be realised in many different ways. These are preferably passive elements, meaning there are no moving parts, but the movement of the sheet along the folding elements is used to make the fold.

In a practical embodiment at least one folding element is a so-called 'pre-folder', with this pre-folder folding said strip over an angle of 90° or approximately 90°.

Here approximately 90° means that the angle is between 45° and 100°, but preferably between 85° and 95°.

At least one folding element is preferably a folder which folds the abovementioned strip over an angle greater than 110°, and even more preferably over an angle greater than 125°.

It is not excluded that this angle is 135°, or that this angle approaches 180°.

The use of such a pre-folder will condition or prepare the sheet to then be able to create a sharp fold with the folder. By creating the fold line in two stages, a clearly defined fold line will be obtained and the strip inadvertently folding or bending in an undesired place during the folding process can be prevented. This will be particularly important with thicker sheets.

It is not excluded according to the invention that the pre-folder and the folder are combined to form one folding element that is a combined pre-folder folder.

An unfolding element is preferably placed after a folding element, said unfolding element being able to unfold the folded over strip back to the plane of the sheet.

This has the advantage that the strip is again well positioned to be able to pack the sheet or for folding with a possible following folding element, that will (possibly) fold the strip of the sheet in the other direction.

According to another preferred embodiment the device is provided with a second pair of slats out of line with the abovementioned first two slats, and with one or more associated folding elements that can fold the strip over or around the second pair of slats in such a way that a second fold line is created at a distance from the first fold line.

The distance between the first and the second fold line can amount to a few millimetres, for example 1 to 3 millimetres or 1 to 5 millimetres. In practice the distance will never amount to more than 10 millimetres, but this is obviously not excluded according to the invention.

In this way sheets can be formed with two fold lines at a distance from each other. Preferably, the two fold lines are parallel, but this is obviously not required.

BRIEF DESCRIPTION OF THE DRAWINGS

With the intention of better showing the characteristics of the invention, some preferred embodiments of a device for the double folding of sheets according to the present invention are described hereinafter by way of an example, without any limiting nature, with reference to the accompanying drawings, wherein.

DETAILED DESCRIPTION OF THE PREFERRED EMBODIMENTS

Figure 1:
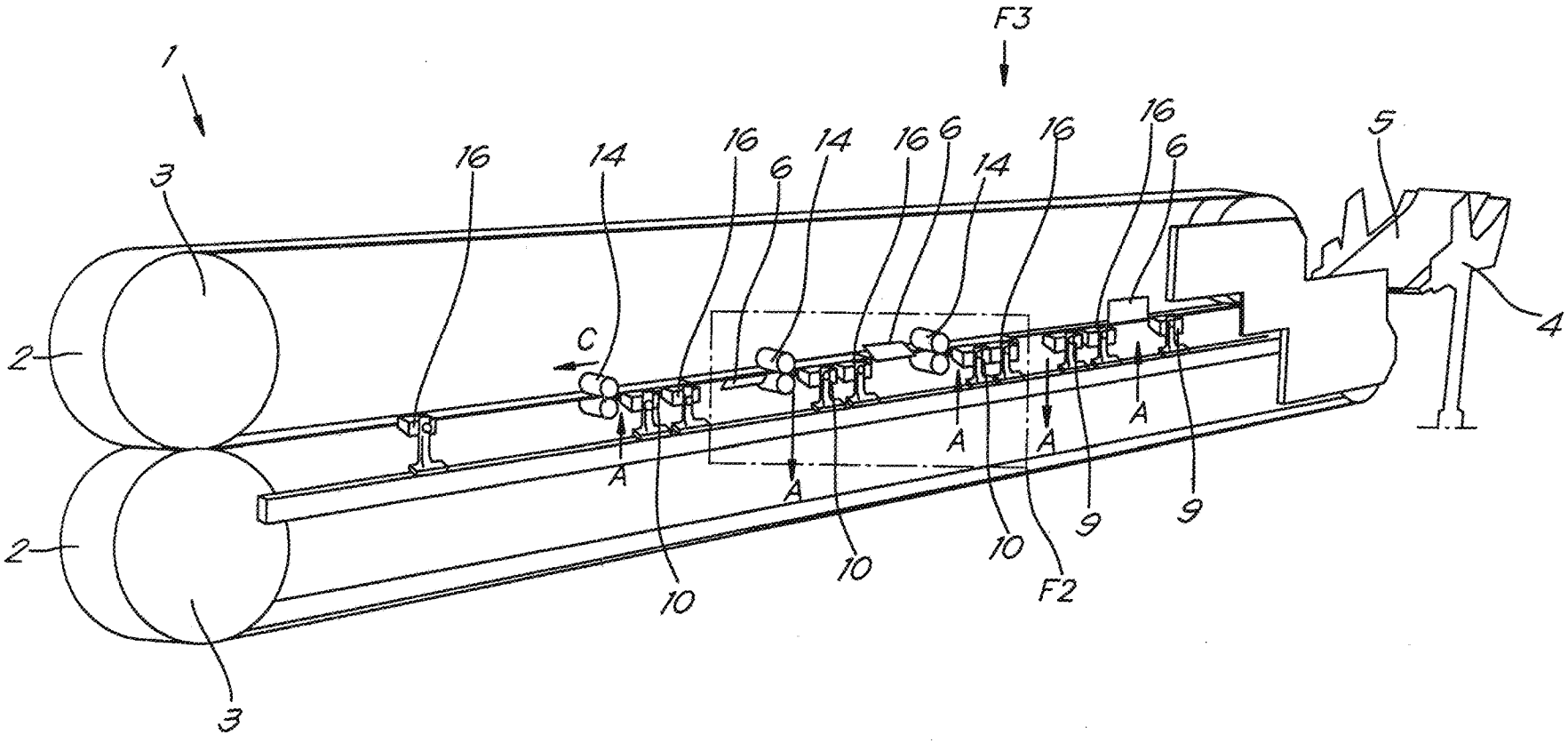
FIG. 1 schematically shows a perspective view of a device for double folding sheets according to the invention.

The device 1 shown in FIG. 1 mainly comprises two transport belts 2 positioned opposite each other.

Here transport belts 2 are also understood to mean puller belts, conveyor belts or suchlike.

The transport belts 2 are the so-called 'endless' type, meaning they form a loop and are fitted so to speak around two reversing drums 3 or reversing wheels.

The transport belts 2 are, in this case and preferably, made of a synthetic material reinforced with steel wire.

This has the advantage that there is strong adhesion with the sheets of paper that will be clamped between the transport belts 2, so during transport between these transport belts 2 the sheet will stay very stably in place.

The device 1 is also provided with a feeder 4 to feed sheets 5 between the transport belts 2. These sheets 5 can be paper sheets 5, but also sheets 5 of (thin) cardboard, synthetic material and suchlike.

The sheets 5 may or may not be printed, for example with text, photos, figures, and suchlike.

Because the transport belts 2 are positioned opposite each other, sheets 5 can be clamped between the transport belts 2 with the exception of a protruding part 6 that protrudes between the transport belts 2.

Figure 2:
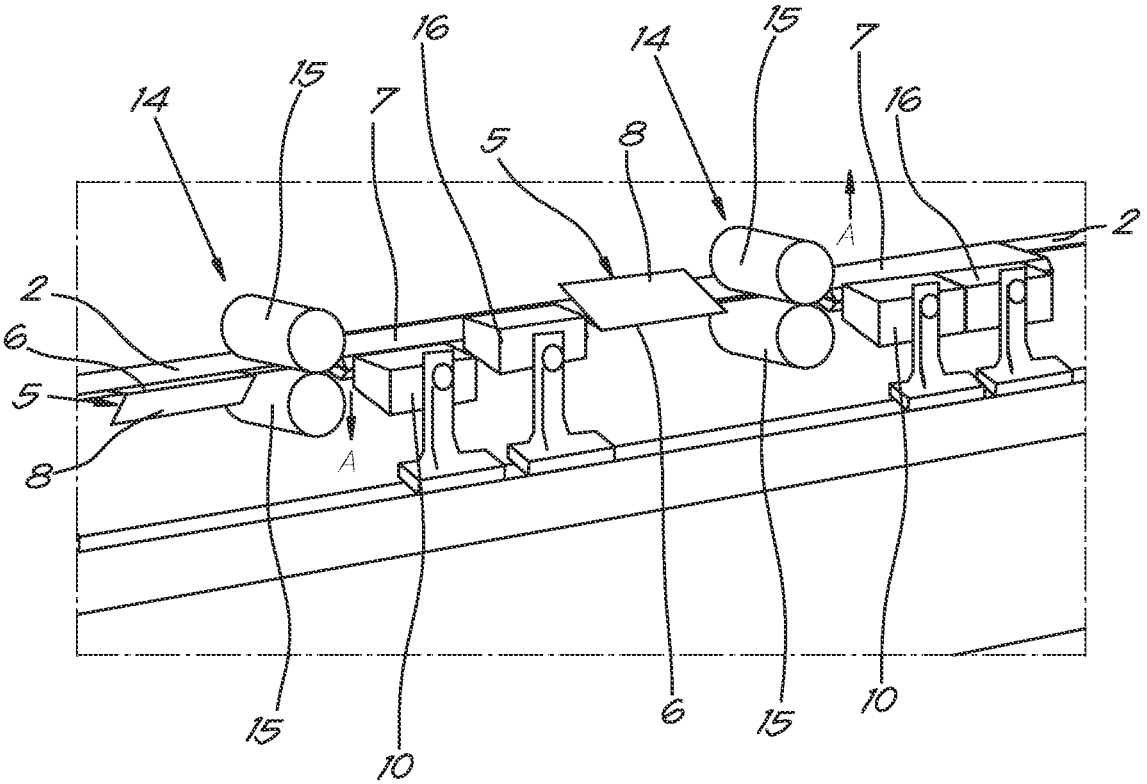
FIG. 2 schematically shows a perspective view of the part indicated in FIG. 1 by F2.
Figure 3:
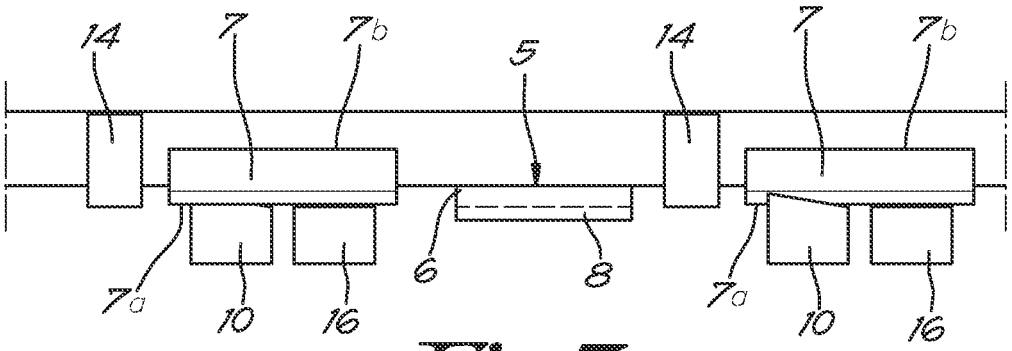
FIG. 3 schematically shows a top view of the device from FIG. 1 with a possible order of the consecutive folding elements.

This is shown in the exploded view in FIGS. 2 and 3.

It is not excluded that the device 1 is provided with more than two transport belts 2 positioned next to each other in twos in such a way that the sheet 5 is clamped between two or more pairs of transport belts 2.

In this case the transport belts 2 are synchronously driven or moved, for example by powering the reversing drums 3.

In this case the device 1 is provided with a number of pairs of slats 7, that extend per two along the transport belts 2, and between which the protruding part 6 of the sheet 5 can slide so a strip 8 protrudes between the slats 7. In this case there are five pairs of slats 7.

Preferably, the two slats 7 of each pair of slats 7 are aligned with each other, meaning that along the side 7*a* of said strip 8 the slats 7 run perfectly level so when the strip 8 is folded around the slat 7, a fold upwards and the fold downwards will be formed exactly on the same fold line.

In addition, all pairs of slats 7 are in line with each other, meaning that each fold made with each folding element will be in exactly the same place.

The slats 7 themselves can be relatively solid or heavy, with a thickness of for example 20 millimetres and a width of 30 millimetres, whereby the slats 7 on the side 7*a* facing the strip 8 become thinner.

The slats 7 along the side 7*a* facing the strip 8 are preferably a maximum of 1.5 millimetres and even more preferably a maximum of 1 millimeter thick. In this case the slats 7 are 0.2 millimetres thick, but it is not excluded that the slats 7 along the side 7*a* are less than 0.2 millimetres in thickness. This to ensure that a clearly defined fold line is obtained. It is not necessary, but also not excluded, that the slats 7 are that thin along their whole width.

The other side 7*b* of the slats will serve in guiding the transport belts 2 so the sheet 5 will continue to pass nicely flat and straight.

The distance between two slats 7 preferably amounts to a maximum of 110% of the thickness of the sheets 5. It is possible that this distance is adjustable, for example with an adjusting screw or suchlike.

A number of folding elements 9, 10 are fitted along the transport belts 2. In this case there are five folding elements 9, 10 fitted. Each folding element 9, 10 is fitted at one of the five pairs of slats 7.

In this case this involves two pre-folders 9 and three folders 10. As can be clearly seen in FIGS. 1 and 3, before the folders 10, that in this case fold the strip 8 over an angle of 135°, the pre-folders 9 are fitted, which in this case fold the strip 8 over an angle of only 90°. This is because as already mentioned above, the pre-folders 9 will condition or prepare the sheet 5 so to speak before the folders 10 fold the strip 8 over a greater angle.

The arrows A indicate in which direction the pre-folders 9 and folders 10 will fold the strip 8 of a sheet 5.

In this case the following folding elements 9, 10 are successively placed:

- a first pre-folder 9 that folds the strip 8 over in one direction;
- a second pre-folder 9 that folds the strip 8 over in the other direction;
- a first folder 10 that folds the strip 8 over in one direction;

a second folder 10 that folds the strip 8 over in the other direction;

After the second folder 10, in this case a third folder 10 is fitted that will again fold the strip 8 over in the one direction. This is however not required for the invention.

Use of the two pre-folders 9 is also not required for the invention. The pre-folders 9 are for example used with thicker types of paper or stiffer materials.

Figure 4:
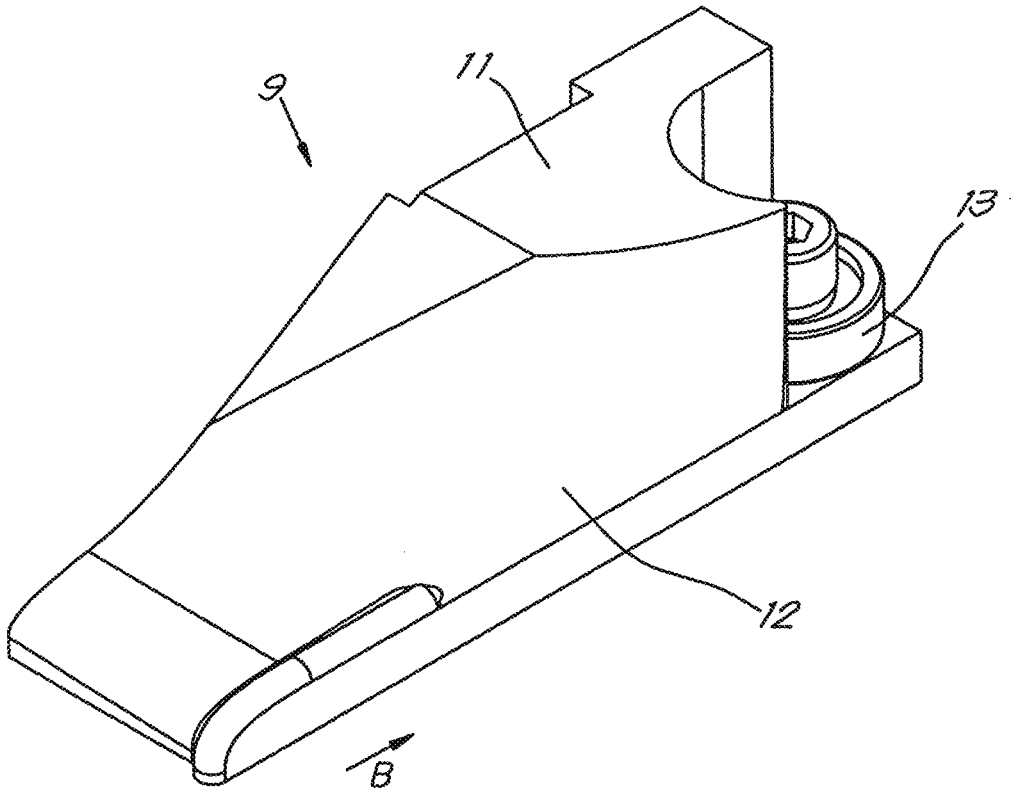
FIGS. 4 to 9 show different embodiments of folding elements and an unfolding element.
Figure 5:
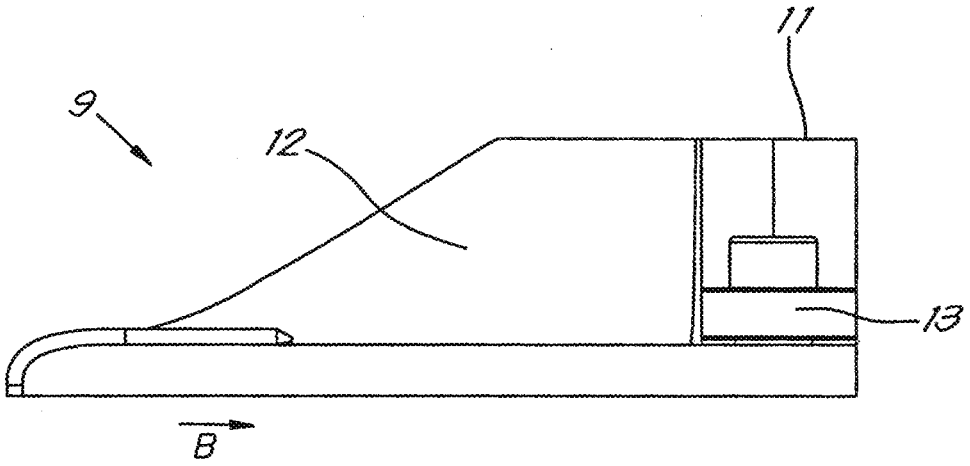
Figure 6:
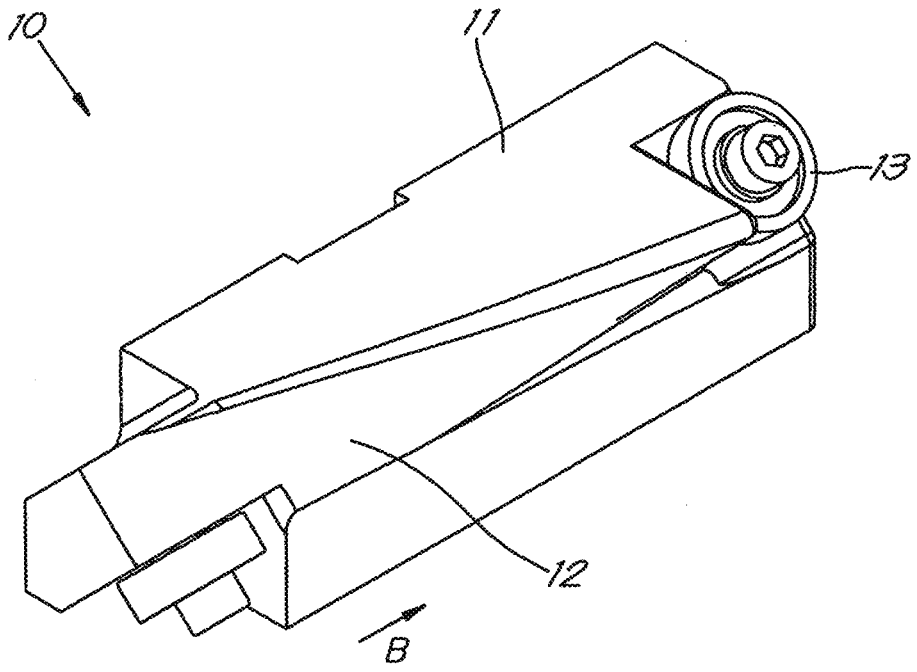
Figure 7:
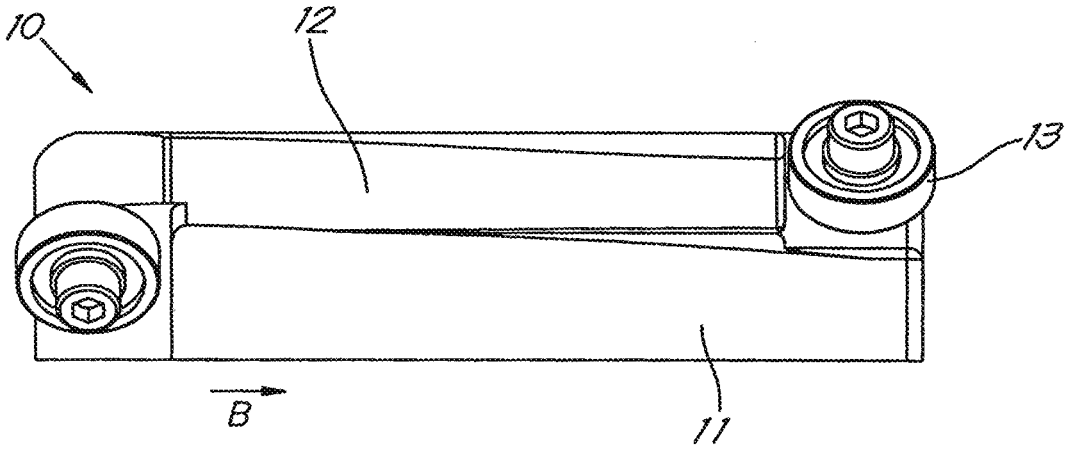

FIGS. 4 to 7 show the possible design of the folding elements 9, 10. FIGS. 4 and 5 show the possible design of a pre-folder 9, while FIGS. 6 and 7 represent the possible design of a folder 10.

The folding elements 9, 10 are, in general, provided as profiled elements 11 with a contact surface 12 or stopper for the strip 8, with the contact surface 12 or stopper, seen along the longitudinal direction of the folding element 9, 10, tilting to be able to fold the strip 8 over.

The angle at which the contact surface 12 tilts is 90° for the pre-folder 9 in FIGS. 4 and 5 and 135° for the folder 10 in FIGS. 6 and 7.

The abovementioned longitudinal direction of the folding element 9, 10 is the direction in which the strip 8 will move along the folding element 9, 10, and is indicated with arrow B in the relative figures.

In this case, but not required for the invention, the folding elements 9, 10 are provided with pressure wheels 13 to press the strip 8 on the side 7*a* of the slat 7, said pressure wheels 13 having the form of a ball bearing.

This ball bearing is fitted in such a way that its outer ring can push on the strip 8.

In this case the folders 10 each are provided with two such ball bearings.

Although in the example shown, the pre-folders 9 and the folder 10 are separate folding elements 9, 10, it is not excluded that these are combined to form one folding element that is a combined pre-folder folder. The consecutive folding elements 9, 10 in the example displayed would then be replaced by a combined pre-folder folder that folds the strip over in one direction and a subsequently fitted combined pre-folder folder that folds the strip over in the other direction, after which an additional folder can also be fitted to again fold the strip over in the first direction.

The device 1 is also provided with pressing elements 14, that are fitted after a folding element 9, 10 and that can press the folded over strip 8 against the sheet 5. At the location of said pressing elements 14 the slats 7 are at least partly discontinued. In the example shown the slats 7 are fully discontinued so different pairs of slats 7 originate.

It is obviously also possible that there is only one pair of slats 7, whereby the slats 7 are discontinued on the side 7*a* at the pressing elements 14, so the pressing elements 14 can make contact with the sheet 5 and the fold. The five separate pairs of slats 7 are then combined to form one pair of slats 7.

There can also, for example, be two or three pairs of slats 7 by for example combining the first two and the last two pairs of slats 7.

A pressing element 14 is fitted after the first folder 10 and the second folder 10. In this case, the device is also provided with a third folder 10, after which a pressing element 10 is also fitted. The latter pressing element 10 could also possibly be left out. If the third folder 10 is not present, this third pressing element 14 is obviously also not present.

In the example shown there are no pressing elements 14 fitted after the pre-folders 9, but this is obviously not excluded.

By using the pressing elements 14, it is possible to manufacture a device 1 according to the invention with only one folding element 9, 10, being a folder 10, followed by a pressing element 14. For thinner types of paper or flexible materials, such a device 1 will be sufficient to obtain a clearly defined fold, because the pressing element 14 allows the fold to be firmly pressed.

However, for normal or thicker types of paper or stiffer materials, it is preferred to provide the device 1 with two folding elements 9, 10, whereby at least one folding element 9, 10 folds the strip 8 over in one direction and at least one folding element 9, 10 folds the strip 8 over in the other direction. These folding elements 9, 10 are then preferably folders 10 and are each followed by a pressing element 14.

Preferably, the pressing element 14 has at least one pressure roller 15 and an opposite counter-pressing element.

Then, for example, at the first pressing element 14, after the folder 10 that has folded the strip 8 upwards, the upper slat 7 could be discontinued, while the bottom slat 7 is not discontinued and serves as a counter-pressing element positioned against it.

By discontinuing the upper slat 7, the pressure roller 15 will firmly press the strip 8 against the sheet 5, whereby the slat 7 will supply strong counter-pressure so a sharp fold is formed under the influence of the pressure between the pressure roller 15 and the slat 7 between which the folded over strip 8 is clamped.

In the example shown, the counter-pressing element is however a second pressure roller 15 and both slats 7 are fully discontinued at the location of the two pressure rollers 15.

Both pressure rollers 15 are driven, meaning they will rotate when the sheet 5 is fed in between.

Although in the example shown pressing elements 14 are used in the form of pressure rollers 15, this is not necessary according to the invention.

A device as shown in FIG. 1, but without the pressing elements 14, also falls under the scope of the invention.

Indeed, with the abrasive effect of the side 7*a* or edge of the slats 7 on the sheet flat against (or in) the fold line, a sharp and clearly defined fold will be obtained so the use of the pressing elements 14 is not required.

In this case the device 1 also has unfolding elements 16 but this is not required. In this case, an unfolding element 16 is fitted after each pressing element 14 and after each pre-folder 9, so the device has a total of five unfolding elements 16.

It is also possible that an unfolding element 16 is only fitted after the three pressing elements 14.

The unfolding element 16 will unfold the folded over strip 8 to the plane of the sheet 5, after it has been folded over by a folding element 9, 10 and possibly pressed by a pressing element 14.

Figure 8:
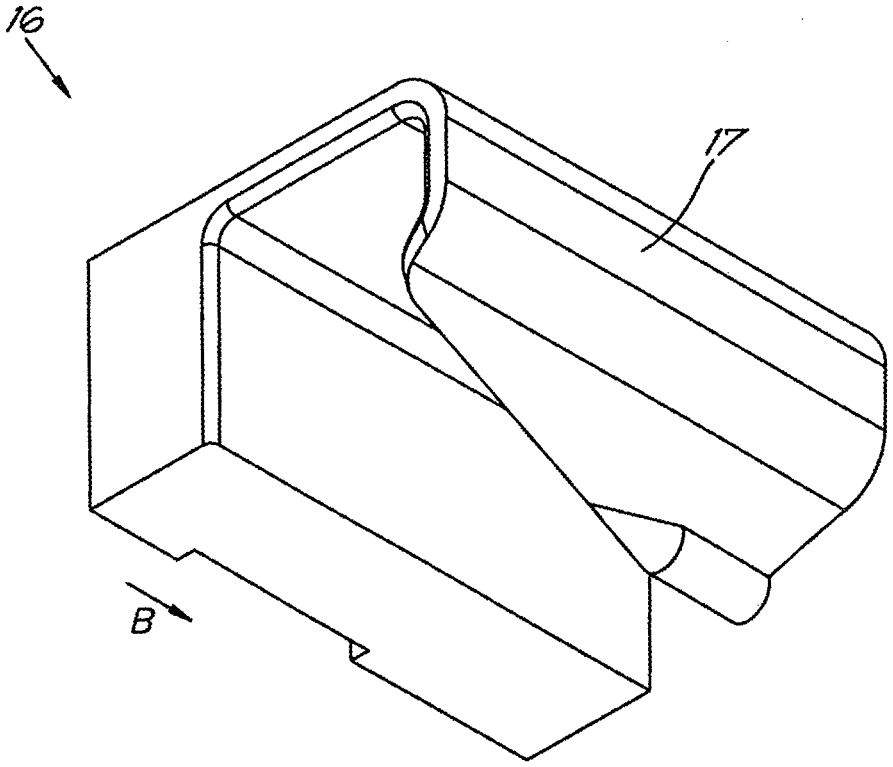
Figure 9:
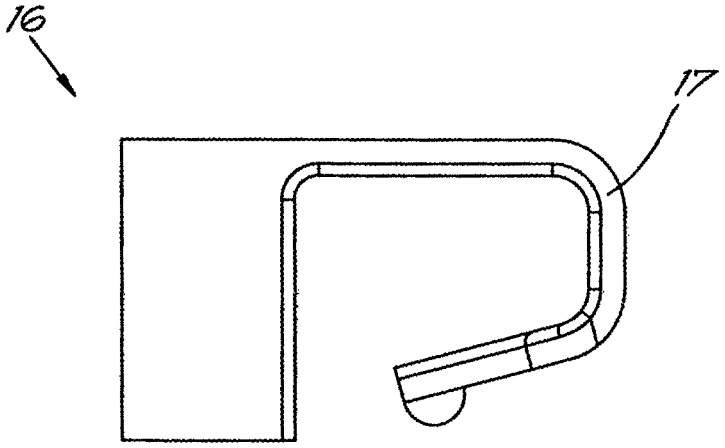

FIGS. 8 and 9 show a possible design of such an unfolding element 16.

As can be seen from these figures, the unfolding element 16 comprises a hook-shaped part 17 that engages behind the folded over strip 8 and that due to its design will fold the strip 8 open when the sheet 5 passes along the unfolding element 16.

The working of the device 1 is very simple and as follows.

A feeder 4 will feed the sheets 5 one by one between the transport belts 2. It is ensured that a protruding part 6 of the sheets 5 protrudes between the transport belts 2.

As already mentioned the transport belts 2 are synchronously driven, and this can be achieved in different ways.

In this case the reversing drums 3 are driven by an electric motor, but hydraulic or pneumatic drive means are also possible.

The device 1 is designed in such a way that the sheets 5 are guided in the direction of arrow C by the drive means of transport belts 2, with their protruding part 6 along the slats 7, the folding elements 9, 10, the pressing elements 14 and the unfolding elements 16.

When the protruding part 6 passes along the slats 7, it will slide in between so a strip 8 protrudes in between.

When this strip 8 then moves along the first pre-folder 9, it will be folded in the direction of arrow A over or around the slat 7.

When strip 8 passes along the ball bearing of the pre-folder 9, the outer ring of the ball bearing will press the strip 8 against the side 7*a* of the slat 7, in this case at an angle of 90°.

Then the sheet 5 will rub against the side 7*a* so to speak.

The following unfolding element 16 will unfold the strip 8 back to the plane of the sheet 5.

Then the same is repeated when the strip 8 passes along the second pre-folder 9 and unfolding element 16, but in the other direction.

The slats 7 are aligned with each other, so the second fold is formed in exactly the same place as the first fold.

Then the protruding part 6 of the sheet 5 passes between the next pair of slats 7, so the strip 8 is guided along the first of the three folders 10 to fold the strip 8 in the direction of arrow A, at an angle of 135°, over or around the slat 7.

When strip 8 passes along the second ball bearing of the folder 10, the outer ring of this ball bearing will press the strip 8 against the side 7*a* of the slat 7, in this case at an angle of 135°.

Then the sheet 5 will rub against the side 7*a* of the slat 7.

Then the sheet 5 with the folded over strip 8 will pass along the first pressing element 14. Because the slats 7 are fully discontinued here, the pressure rollers 15 will press the folded over strip 8 against the sheet 5 to form a very sharp and clearly defined fold.

Then the sheet 5 passes via the fourth pair of slats 7 along the third unfolding element 16 to fold the strip 8 back into the plane of the sheet 5, before the strip 9 is folded over by the second and third folder 10, in the directions of the relative arrows A, as shown in FIGS. 1 and 2.

The folded strip 8 will pass along the second and third pressing element 14, so the fold can each time be firmly pressed by the pressure rollers 16.

Because the slats 7 are very thin, or at least the side 7*a* along the side of the strip 8, and because the slats 7 run perfectly level along the side 7*a* of the strip 8, a good fold line can be obtained when a folding element 9, 10 folds the strip 8 over and the strip 8 will be folded over double on exactly the same line. This is why it is important that the slats 7 are preferably a maximum of 1 millimeter thick.

When the sheet 5 has arrived at the end of the transport belts 2, the strip 8 will be folded over double in both directions and in this case one extra time in the one direction.

The sheet 5 can then be used in a book or folder whereby the sheets 5 can be folded open flat and printing can seamlessly continue over the two folded open sheets 5.

Because the five pairs of slats 7 are all in line with each other, all fold lines are in exactly the same place.

If one or more pairs of slats 7 are out of line, meaning not aligned with the other pairs of slats 7, the relative fold line will be made in another location or place, so two fold lines will ultimately be obtained.

Although in the example shown, folding elements 9, 10 are only fitted on one side of the transport belts 2, as clearly visible in FIG. 3, it is not excluded that 2 folding elements 9, 10 are fitted on each side of the transport belts 2 along the transport belts 2, whereby sheets 5 are clamped between the transport belts 2 both with their protruding part 6 along the one side and with their protruding part 6 along the other side of the transport belts 2.

In other words: the protruding part 6 of a sheet 5 will be either on the one side, or on the other side of the transport belt 2.

If the transport belts 2 are wide enough, the sheets 5 can be fed into the device 1 in twos side by side.

If this is not the case, the sheets 5 can alternately protrude with their protruding part 6 on the one side or on the other side of the transport belts 2.

Alternatively, wider sheets can also be used to fold a sheet on both sides of the strip 8, whereby these sheets are then cut into two parts, so two sheets are obtained and production is doubled.

It is clear that in the embodiments described above, the length of the transport belts 2 must be chosen in such a way that the necessary numbers of folding elements 9, 10 can be fitted along the conveyor belts 2.

If, for example, the sheets 5 are made of thicker or tougher material, it is possible that in the embodiment in FIG. 1 a further number of additional folders 10 with associated pressing elements 14 and unfolding elements 16 must be fitted. The transport belts 2 are then made longer, so the extra folders 10, pressing elements 14 and unfolding elements 16 can be fitted after the last unfolding element 16.

Instead of making the transport belts 2 longer it is also possible to fit or assemble shorter transport belts 2 next to or after each other, so the same effect of longer transport belts 2 is obtained but with standard transport belts 2.

Likewise, the device 1 can be provided with only one folder 10, pressing element 14 and unfolding element 16 or with two folders 10, two pressing elements 14 and two unfolding elements 16. For normal to somewhat thicker paper one or two folders 10 will suffice, because the fold formed will be firmly pressed by the pressing elements 14. In this case, the transport belts 2 will be much shorter so a compact device 1 can be obtained.

Although in the examples described above the device 1 is provided with two transport belts 2, it is not excluded that the device 1 is provided with more than two transport belts 2 fitted opposite each other.

As a result, 2 sheets 5 can each time be clamped between two adjacent transport belts with a protruding part 6 that protrudes between the transport belts 2, for example between the first and the second and between the second and the third transport belt 2.

Here the first and the second transport belt 2 will move the sheets 5 in the one direction C and the second and the third transport belt 2 will move the sheets 5 in the opposite direction opposite to direction C.

Obviously in this case the device 1 will be provided with two series of folding elements 9, 10 with associated slats 7 and pressing elements 14, one series at the level of the sheets 5 between the first and second transport belt 2 and one series at the level of the sheets 5 between the second and third transport belt 2.

With more than three transport belts 2, the number of series of folding elements 9, 10, slats 7 and pressing elements 14 is increased likewise.

The series of folding elements 9, 10 can be equivalent but can also be different, both as regards number and type of folding elements (pre-folder 9 or folder 10).

The present invention is by no means limited to the embodiments described as an example in the drawings, and a device for the double folding of sheets according to the invention can be realized in all kinds of variants and dimensions, without departing from the scope of the invention.

The invention claimed is:

1. A device for folding sheets (5), the device comprising:
- two transport belts (2) positioned opposite each other in such a way that sheets (5) can be clamped between the transport belts (2) with the exception of a protruding part (6) that protrudes between the transport belts (2);
- drive means for driving the transport belts (2);
- two slats that (7) extend along the transport belts (2) and between which the protruding part (6) can slide so a strip (8) protrudes between the slats (7);
- one or more folding elements (9, 10) along the transport belts (2) that can fold the abovementioned strip (8) over or around a slat (7) to form a fold line,
- the device (1) configured so as to guide the sheets (5) with the strip (8) along the folding elements (9, 10) and the slats (7) by the drive means of the transport belts (2).

2. The device according to claim 1, wherein the device (1) is provided with at least two folding elements (9, 10), whereby at least one folding element (9, 10) folds the strip (8) over in a first direction and at least one folding element (9, 10) folds the strip (8) over in a second direction opposite the first direction.

3. The device according to claim 1, wherein the slats (7) on the side (7*a*) of the strip (8) are aligned with each other.

4. The device according to claim 1, characterised in that at least one folding element (9, 10) is a pre-folder (9) that folds over the abovementioned strip (8) at an angle of 90°.

5. The device according to claim 4, wherein at least one folding element (9, 10) is a folder (10) that folds over the abovementioned strip (8) at an angle greater than 110°.

6. The device according to claim 5, wherein one or more pre-folders (9) are fitted before the one or more folders (10).

7. The device according to claim 1, wherein along the transport belts (2) the following are successively placed:
- a first pre-folder (9) that folds the strip (8) over in the one direction at an angle of 90°;
- a second pre-folder (9) that folds the strip (8) over in the other direction at an angle of 90°;
- a first folder (10) that folds the strip (8) over in the one direction at an angle greater than 110°;
- a first pressing element (14) that will press the folded over strip (8) against the sheet (5);
- a second folder (10) that folds the strip (8) in the other direction at an angle greater than 110°;
- a second pressing element (10) that will press the strip (8) against the sheet (5).

8. The device according to claim 1, wherein after a folding element (9, 10), an unfolding element (16) is fitted, which can fold (16) the folded over strip (8) back to the plane of the sheet (5).

9. The device according to claim 1, further comprising:
- one or more pressing elements (14) that are fitted after a folding element (9, 10) and that can press the folded over strip (8) against the sheet (5) and the fold line, whereby the abovementioned slats (7) are at least partly discontinued at the location of the pressing elements (14).

10. The device according to claim 9, wherein the pressing element (14) has at least one pressure roller (15) and an opposite counter-pressing element.

11. The device according to claim 10, wherein the counter-pressing element is either a second pressure roller (15) or is formed by one of the slats (7).

12. The device according to claim 10, wherein the pressure roller (15) is driven.

13. The device according to claim 9, wherein along the transport belts (2) the following are successively placed:
- a first pre-folder (9) that folds the strip (8) over in the one direction at an angle of 90°;
- a second pre-folder (9) that folds the strip (8) over in the other direction at an angle of 90°;
- a first folder (10) that folds the strip (8) over in the one direction at an angle greater than 110°;
- a first pressing element (14) that will press the folded over strip (8) against the sheet (5);
- a second folder (10) that folds the strip (8) in the other direction at an angle greater than 110°;
- a second pressing element (10) that will press the strip (8) against the sheet (5).

14. The device according to claim 1, wherein after a pressing element (14), an unfolding element (16) is fitted, which can fold the folded over strip (8) back to the plane of the sheet (5).

15. The device according to claim 1, further comprising:
- a second pair of slats (7) out of line with the abovementioned first two slats (7), and one or more associated folding elements (9, 10) that can fold the strip (8) over or around the second pair of slats (7) in such a way that a second fold line is created at a distance from the first fold line.

16. The device according to claim 1, wherein the folding elements (9, 10) are profiled elements (11) with a contact surface (12) or stopper for the strip, with the contact surface (12) or stopper, seen along the longitudinal direction of the folding element, tilting to be able to fold the strip (8) over.

17. The device according to claim 1, wherein the slats (7) along the side (7*a*) of the strip (8) have a maximum thickness of 1.5 millimetres.

18. The device according to claim 1, wherein the distance between the two slats (7) is a maximum of 110% of the thickness of the sheet (5).

19. The device according to claim 1, wherein the transport belts (2) are made of a synthetic material reinforced with steel wire.

20. The device according to claim 1, wherein the device (1) is provided with a feeder (4) to feed the sheets (5) between the transport belts (1).

21. The device according to claim 1, wherein on each side of the transport belts (2) folding elements (9, 10) are fitted along the transport belts (2), whereby both sheets (5) are clamped between the transport belts (2) both with their protruding part (6) along the one side and with their protruding part (6) along the other side.

22. The device according to claim 1, wherein the transport belts (2) are synchronously driven or moved.

23. The device according to claim 1, wherein the device (1) is provided with more than two transport belts (2) positioned next to each other in twos in such a way that the sheet (5) is clamped between two or more pairs of transport belts (2).

24. The device according to claim 1, wherein the length of the transport belts (2) is chosen in such a way that the necessary numbers of folding elements (9, 10) and pressing elements (14) can be fitted along the transport belts (2).

* * * * *